US007162835B1

(12) United States Patent
Manpuku et al.

(10) Patent No.: US 7,162,835 B1
(45) Date of Patent: Jan. 16, 2007

(54) GRAVITY SAFETY DOOR FOR AN APPARATUS FOR MANUFACTURING OR INSPECTING SEMICONDUCTORS

(75) Inventors: Yasuhiro Manpuku, Ome (JP); Kazunori Hiranuma, Hachioji (JP); Mamoru Takashina, Hachioji (JP)

(73) Assignee: Tokyo Seimitsu, Co., Ltd, Tokyo (JP)

( * ) Notice: Subject to any disclaimer, the term of this patent is extended or adjusted under 35 U.S.C. 154(b) by 0 days.

(21) Appl. No.: 09/438,100

(22) Filed: Nov. 10, 1999

(30) Foreign Application Priority Data

Dec. 1, 1998 (JP) ..... 10-341423

(51) Int. Cl.
*E05F 15/08* (2006.01)

(52) U.S. Cl. ..... 49/26; 49/116; 49/118; 49/370

(58) Field of Classification Search ..... 49/360, 49/116, 117, 120, 370, 501, 137, 28, 142, 49/304, 306, 119, 118, 315, 366, 26
See application file for complete search history.

(56) References Cited

U.S. PATENT DOCUMENTS 910,654 A * 1/1909 Evans ..... 187/331
1,175,925 A * 3/1916 Bumbarger ..... 49/370
RE14,637 E * 4/1919 Wexler ..... 49/370
2,488,257 A * 11/1949 Anderson ..... 49/370
2,737,781 A * 3/1956 Gelfand et al. ..... 49/370
3,758,989 A * 9/1973 Rompa ..... 49/120
5,237,777 A * 8/1993 Houston et al. ..... 49/360
5,261,736 A * 11/1993 Sisbarro ..... 312/319.8
5,269,098 A * 12/1993 Redman ..... 49/360
5,791,087 A * 8/1998 Strab ..... 49/360
6,055,777 A * 5/2000 Rekioja ..... 49/360

FOREIGN PATENT DOCUMENTS

JP 54-105148 7/1979

* cited by examiner

*Primary Examiner*—Gregory J. Strimbu
(74) *Attorney, Agent, or Firm*—Christie, Parker & Hale LLP

(57) ABSTRACT

An apparatus for manufacturing or inspecting semiconductors comprising a main body, an opening arranged in the main body, and a safety door. The safety door includes a first door element for covering a first portion of the opening and a second door element for covering a second portion of the opening, the first door element having a movement direction along which the first door element is driven by a driving device, the second door element being urged toward the first door element along the movement direction of the first door element by an external force. If a part of a person's body should be caught between the first and second door elements, the second door element is urged against the external force by the force generated by the part of the person's body to protect the part of the person's body.

16 Claims, 7 Drawing Sheets

GRAVITY SAFETY DOOR FOR AN APPARATUS FOR MANUFACTURING OR INSPECTING SEMICONDUCTORS

BACKGROUND OF THE INVENTION

1. Field of the Invention

The present invention relates to a safety door equipped with a safety structure which ensures safety in case a part of an operator's body should be put in an opening when the opening is closed by the safety doors. The present invention further relates to an apparatus, for manufacturing or inspecting semiconductors, having the safety door.

2. Description of the Related Art

When an automatic door opens and closes an opening in a partition wall located between different spaces, there are some risks of catching a part of a person's body, such as fingers or a hand, in the door when the person works around the opening.

For example, in most apparatuses for manufacturing or inspecting semiconductors, an opening is provided on a wall of the apparatus for transferring a wafer from a wafer cassette placed outside into the apparatus. In such the apparatus, an automatic handling robot is used for transferring wafers from the wafer cassette through the opening into the apparatus, and an automatic door for covering the opening is provided at the opening so that it can automatically open and close the opening. An exchange of the wafer cassette placed outside the apparatus is made typically by a person (for example an operator). Therefore, there is some risk of catching a part of the person's body in the automatic door and crushing it during the exchange operation for the wafer cassette.

In order to prevent a person from catching a part of his body in the automatic door, a guard fence for preventing a person approaching is typically provided around the opening or the automatic door. If a person has to work near the opening or the automatic door as in the case mentioned above, it is necessary to take steps to detect a person near the opening or the automatic door by means of an area sensor or the like and thereby to control the operation of the safety door of the apparatus so as to prevent the safety door from closing and opening when some person is near the opening or the automatic door.

However, when the operation of the automatic door is controlled, using sensors such as area sensors, by software of a controller or others, it is possible that an incorrect action may happen in the automatic door due to faults in software or hardware, such as sensors and the controller, and thereby a part of a person's body may be caught in the automatic door.

SUMMARY OF THE INVENTION

It is therefore an object of the present invention to provide a safety door equipped with a safety structure, which does not prevent a person from catching a part of his body in the safety door but which does avoid injuries caused by crushing the part of his body if the automatic door should act incorrectly to catch a part of the body in the safety door. It is a further object to provide an apparatus, for manufacturing or inspecting semiconductors, having such the safety door.

According to the present invention, there is provided an apparatus, for manufacturing or inspecting semiconductors, having a safety door, which includes a main body for manufacturing or inspecting semiconductors; an opening arranged in the main body; and a safety door which includes a first door element for covering a part of the opening, the first door element having a movement axis along which the first door element is driven by a driving device, and a second door element for covering a part of the opening, the second door element urged toward the first door element and able to move in parallel to the movement axis of the first door element, wherein the first door element cooperates with the second door element to close the whole of the opening.

When the first door element is driven in order to close the opening and then a part of a person's body, for example fingers or a hand, is caught in the safety door, the second door element for closing the part of the opening, which is urged by the urging means, moves along with the first door element in a direction of the movement thereof and the first door element stops at a position where only a part of the opening is covered with the first door element. At that time, a force applied to the part of the body is substantially caused by only a force urging the second door element, so that the apparatus can avoid risks of crushing the part of the body.

In one preferred embodiment of the apparatus, for manufacturing or inspecting semiconductors, having the safety door according to the present invention, the first door element may be arranged on a lower side in the main body, and the second door element may be arranged on an upper side in the main body, the second door element being urged toward the first door element by gravity.

In another preferred embodiment of the apparatus, for manufacturing or inspecting semiconductors, having the safety door according to the present invention, the first door element may be arranged on an upper side in the main body, and the second door element may be arranged on a lower side in the main body, the second door element being urged toward the first door element by urging means. Preferably, the urging means may comprise springs.

In one preferred embodiment of the ends of the two door elements in the safety door in the apparatus according to the present invention, the first door element may abut against the second element so that the first and second door elements cooperate with each other to close the whole of the opening.

In another preferred embodiment of the ends of the two door elements in the safety door in the apparatus according to the present invention, the first door element may overlap the second door element so that the first and second door elements cooperate with each other to close the whole of the opening.

Preferably, the apparatus, for manufacturing or inspecting semiconductors, may further include a detector for detecting displacement of the second door element.

The detector can detect the part of the body caught in the safety door by detecting displacement of the second door element of the safety door so that the apparatus can drive the first door element to make the opening open so as to eliminate the state of a part of a body caught in the safety door.

According to the present invention, there is also provided a safety door, for closing an opening arranged in a wall, which includes a first door element for covering a part of the opening, the first door element having a movement axis along which the first door element is driven by a driving device, and a second door element for covering a part of the opening, the second door element urged toward the first door element and able to move in parallel to the movement axis of the first door element, wherein the first door element cooperates with the second door element to close the whole of the opening.

BRIEF DESCRIPTION OF THE DRAWING

The above and other objects, features, and advantages of the present invention will be made more apparent from the following description of the preferred embodiments thereof with reference to the accompanying drawings, wherein.

DESCRIPTION OF THE PREFERRED EMBODIMENTS

Figure 1:
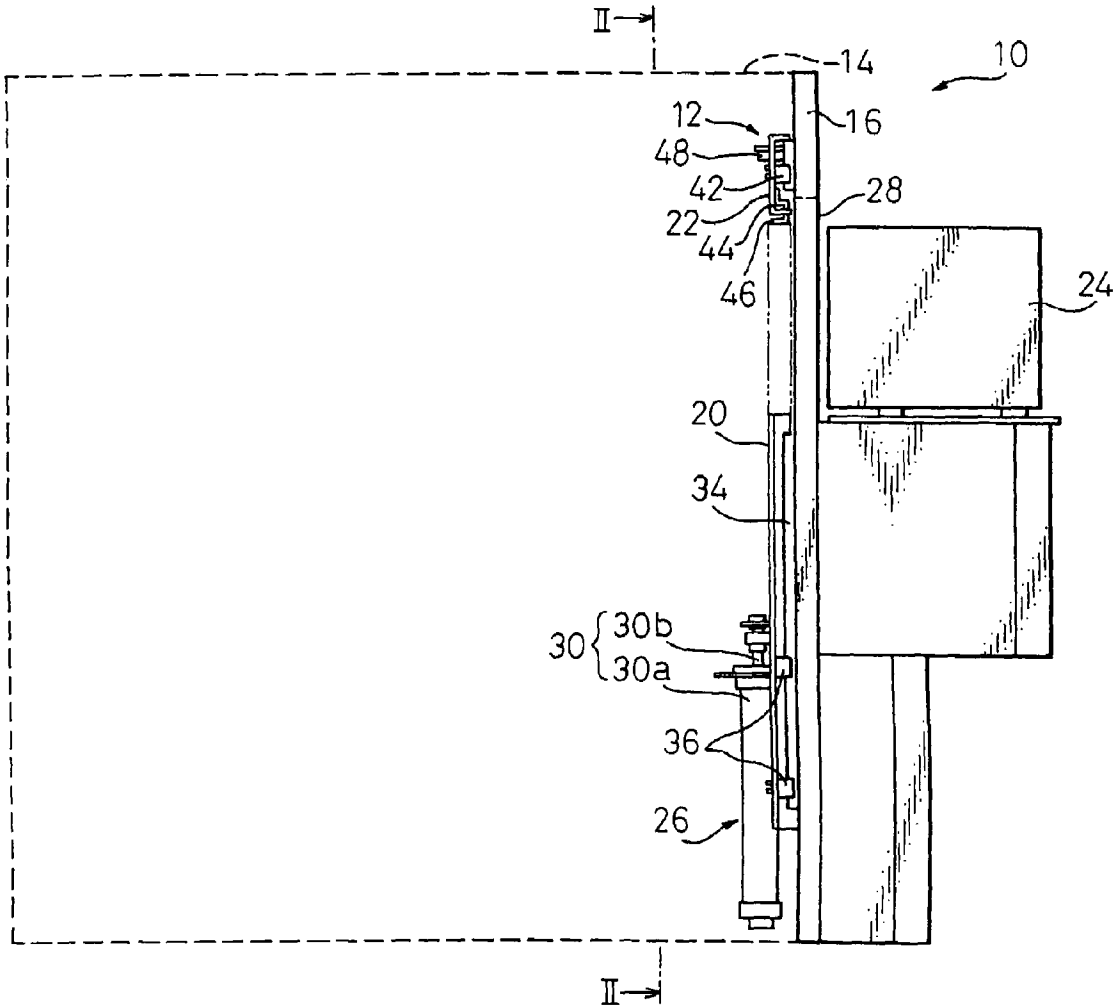
FIG. 1 is a side view of an apparatus for manufacturing semiconductors having a safety door for closing an opening according to a preferred embodiment of the present invention.
Figure 2:
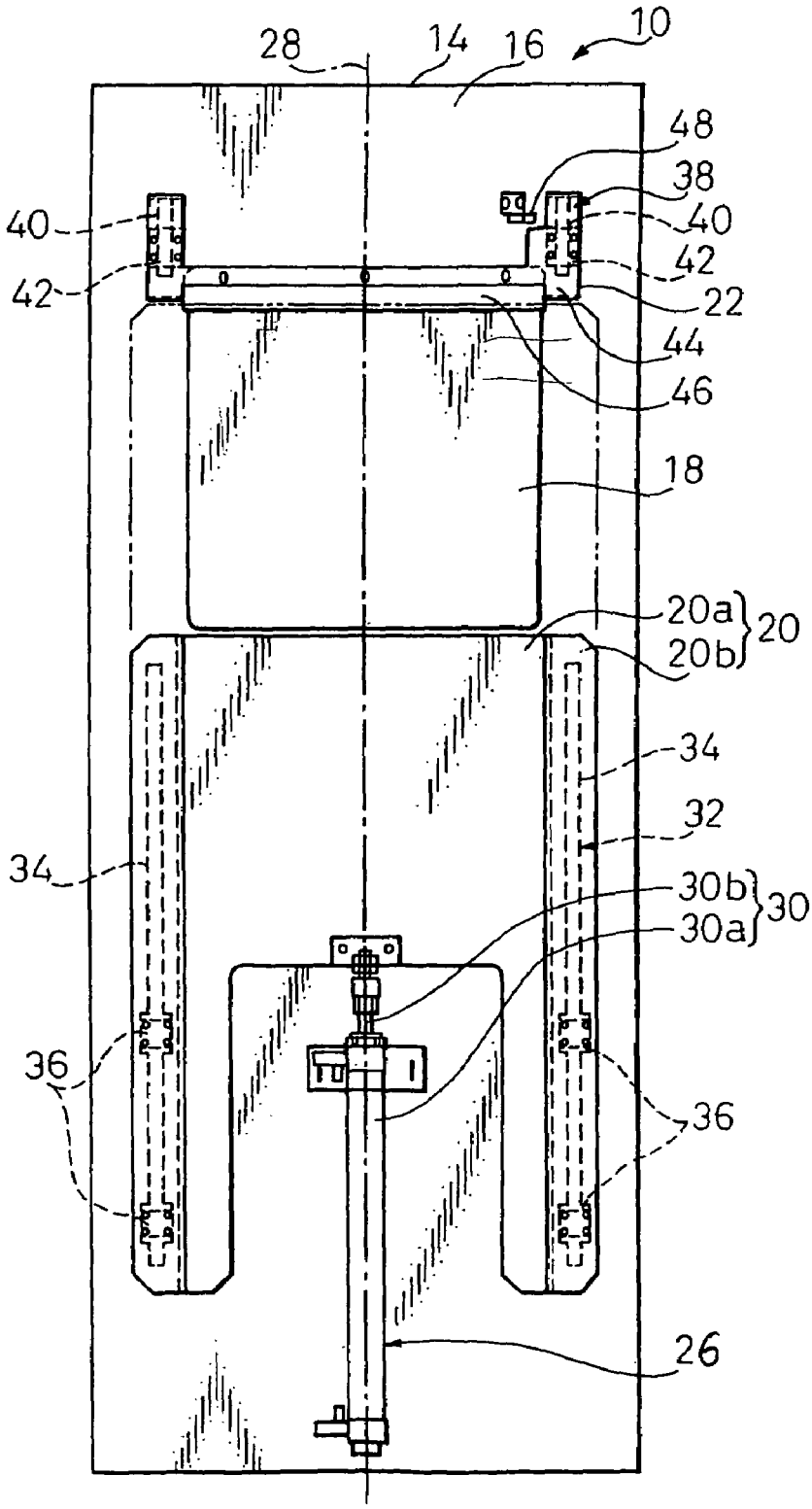
FIG. 2 is a view seen from line II—II, showing one embodiment of the safety door of the apparatus shown in FIG. 1, the safety door including a driven first door element and a second door element urged toward the former by gravity.

FIG. 1 is a side view of an apparatus 10 for manufacturing semiconductors having a safety door 12 according to the present invention, and FIG. 2 is a view seen from line II—II, showing one embodiment of the safety door of the apparatus 10 shown in FIG. 1. For simplification, a main body of the apparatus for manufacturing or inspecting semiconductors is schematically shown by a phantom line in FIG. 1. Please note that the term "an apparatus for manufacturing semiconductors" herein includes apparatuses for manufacturing semiconductors, one for inspecting them, and one for manufacturing and inspecting them.

The apparatus 10, for manufacturing semiconductors, having a safety door 12 includes a main body or device 14 for manufacturing or inspecting semiconductors, an opening 18 arranged in a wall (partition wall) 16 of the main body 14, a first door element 20, and a second door element 22. The widths of the first door element 20 and the second door element 22 are sufficient to cover the whole of a width of the opening 18 arranged in the main body 14. A wafer is transferred from a wafer cassette 24 placed outside the main body 14 into the inside thereof through the opening 18 arranged in the wall 16 of the main body 14.

The first door element 20 has a movement axis 28 along which it is driven by a driving device 26. In FIGS. 1 and 2, an air cylinder 30 including a cylinder body 30*a* and a movable piston 30*b* therein is used as the driving device 26. The air cylinder 30 is mounted on the wall 16 of the main body 14 and the first door element 20 is fixedly secured to the movable piston 30*b*. One air cylinder 30 is shown in FIG. 1, but a plurality of air cylinders may be used in the apparatus 10 having the safety door 12 according to the present invention. Other types of devices can be used as the driving device 26, such as an air cylinder, a linear actuator (for example, a linear motor), or a rotary motor used with an associated gear mechanism or others.

The first door element 20 may further be provided with a guiding device 32 for guiding the first door element along the movement axis 28 thereof. In FIGS. 1 and 2, the guiding device 32 which includes slides 36 associated with two guiding rails 34 is used. The slides 36 are mounted at appropriate places on the right and left sides of the first door element 20 by any connecting means so that they can guide the first door element 20 by sliding on the guiding rails 34 mounted on the wall 16 of the main body 14. In the embodiment shown in FIG. 1, two guiding rails 34 are spaced apart below the opening 18 by a distance larger than the width of the opening 18. Any other suitable guiding device, such as linear bearings and the like, may be used instead of the combination of the guiding rails 34 and the slides 36. Note that the safety door 12 is not necessarily provided with the guiding device 32 when an air cylinder or a linear actuator is used as the driving device 26. For example, when an air cylinder is used, it can perform a guiding function for moving the first door element 20 along a predetermined movement axis 28 thereof.

The first element 20 is adapted to leave a gap of about 15–20 mm height in the opening even when the first door element 20 is guided by the driving device 26 or the guiding device 32 to move to the limit position on the side of the second door element 22 in the mechanically restricted movable region thereof. The gap is covered with the second door element 22 which is urged toward the first door element 20 but is not driven by a driving device.

Preferably, the first door element 20 is stepped with the both right and left side portions 20*b* along edges of the first door element 20 higher than the middle portion 20*a* between the two side portions, in order to prevent the first door element from being positioned too far away from a plane of the opening 18 in the wall 16 of the main body 14 when the slides 36 are mounted in both the side portions of the first door element 20. The first door element 20 is also provided with a recess in the bottom of the middle portion thereof, as shown in FIG. 1. This recess is intended to lighten the first door element 20 and to provide a space for the driving device 26, for example an air cylinder, to be positioned.

Figure 3:
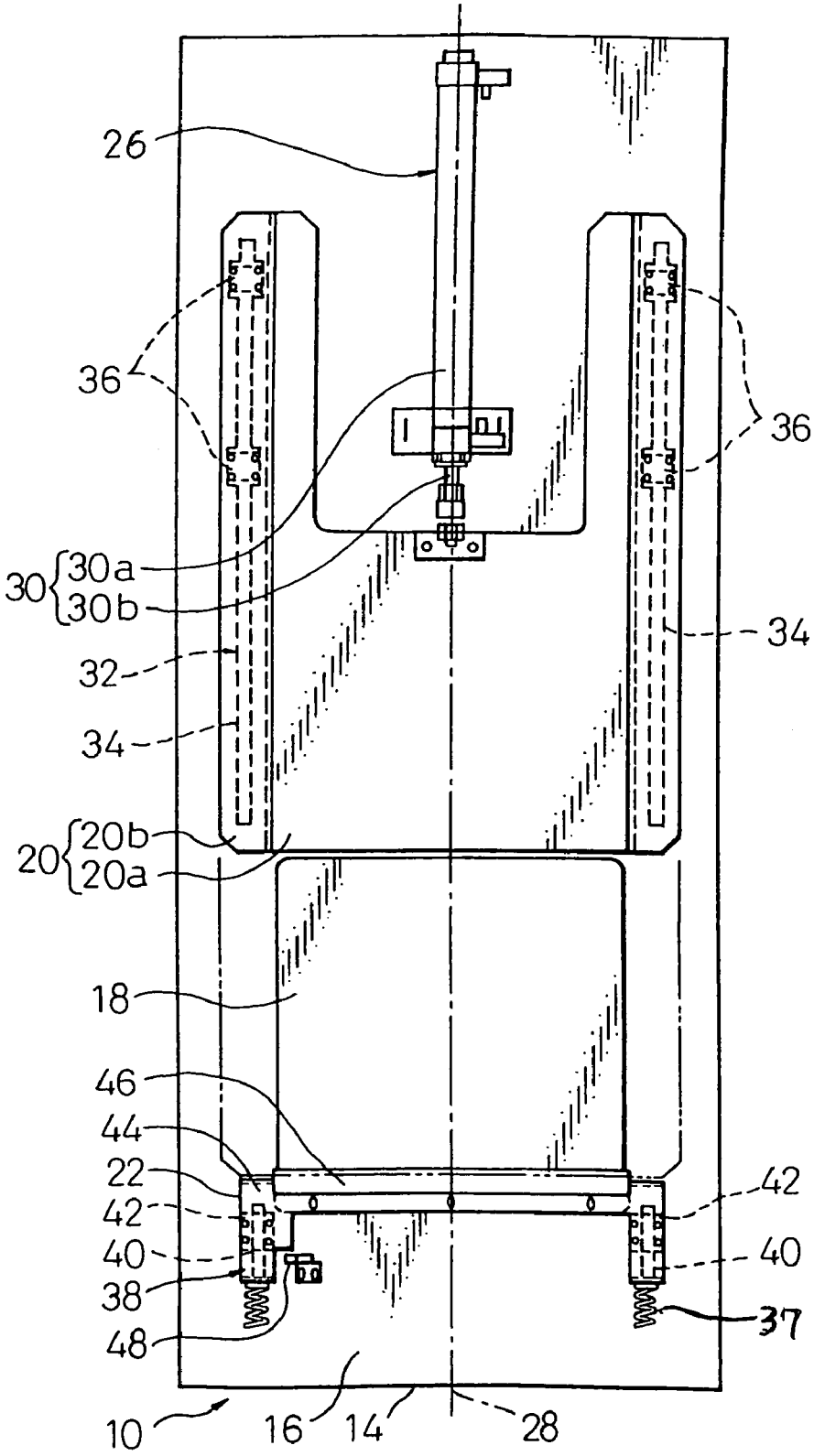
FIG. 3 is a view of another embodiment of a safety door portion similar to that shown in FIG. 2, except that the first and second door element are inverted and that the second door element is urged by springs.

The second door element 22 is urged toward the first door element 20 and can move along the same movement axis as the movement axis 28 of the first door element 20. When the second door element 22 is arranged above the first door element 20 as shown in FIGS. 1 and 2, the second door element 22 is urged toward the first door element 20 by gravity. On the other hand, when the second door element 22 is arranged below the first door element 20 as shown in FIG. 3, the second door element 22 is urged toward the first door element 20 by urging means, such as springs 37, rubber, an elastomer or the like. When the second door element 22 is urged toward the driven first door element 20 by the urging means, the first door element 20 and the second door elements 22 may be arranged on the right and left sides of the opening 18, respectively, to close the opening 18 from the both sides thereof.

Preferably, the second door element 22 also has the movement axis 28 in common with the first door element 20 and is further provided with a guiding device 38 for moving it along the movement axis 28 thereof. In the embodiment shown in FIGS. 1–3, the guiding device 38 includes slides 42 associated with two guiding rails 40, which are spaced apart from each other by a distance greater than the width of the opening 18 and which is arranged above the opening 18 in FIGS. 1 and 2 (which is arranged below the opening 18 in FIG. 3).

Figure 4:
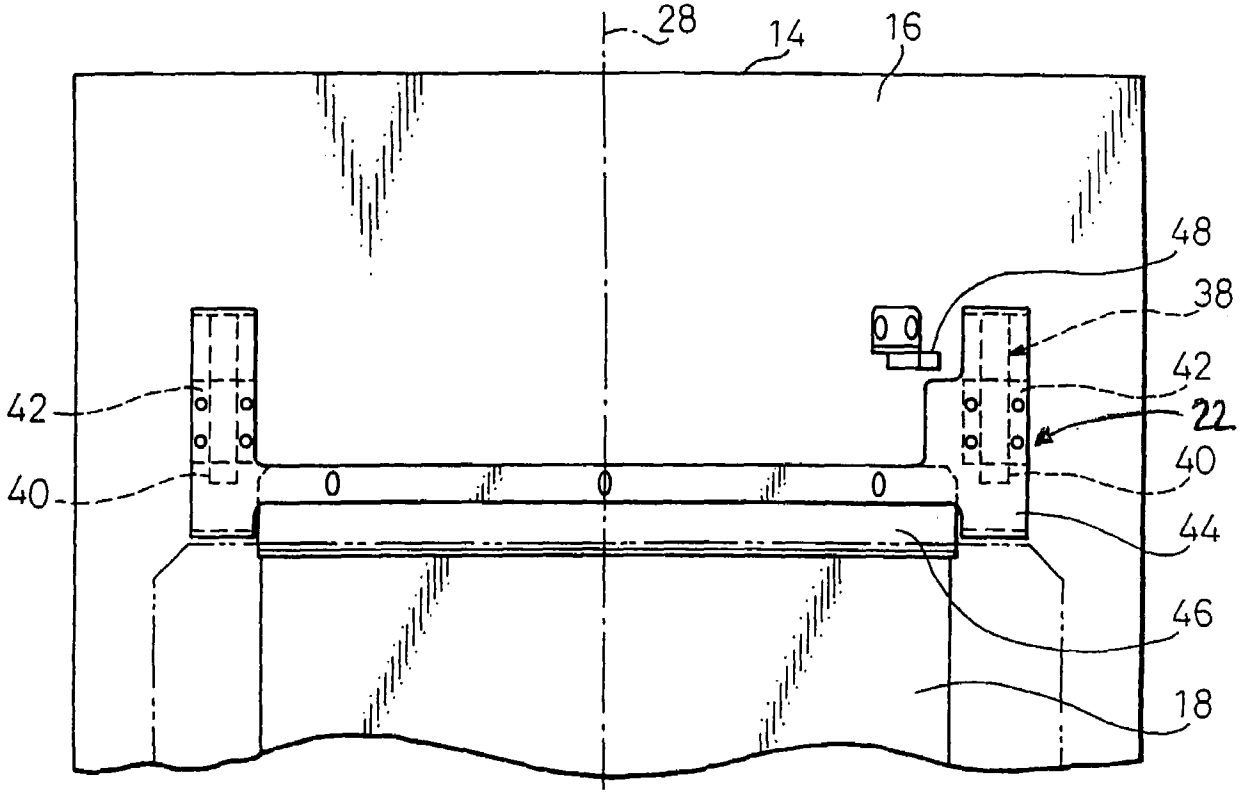
FIG. 4 is an enlarged detail view showing a portion around the second door element in the safety door shown in FIG. 2.
Figure 5:
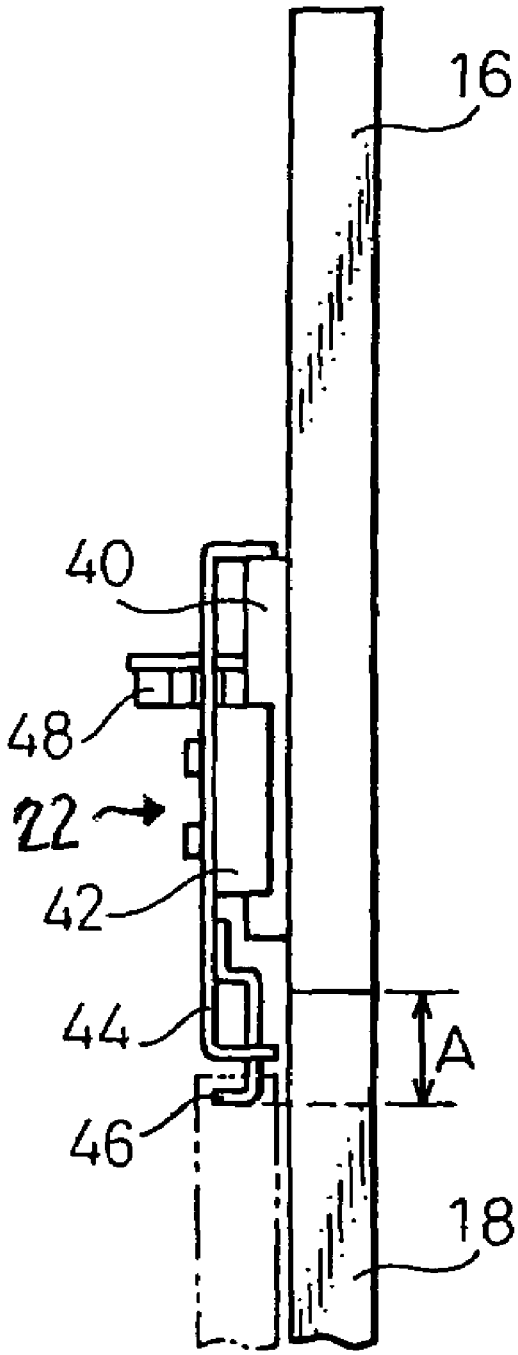
FIG. 5 is a side view of the portion shown in FIG. 4.

FIG. 4 is an enlarged detail view showing a portion around the second door element 22 in the safety door 12 shown in FIG. 2, and FIG. 5 is a side view of the portion shown in FIG. 4.

In FIGS. 4 and 5, the second door element 22 includes the guiding device 38, a supporting plate 44 secured to the slides 42 of the guiding device 38, and a door member 46 mounted on the supporting plate 44. The second door element 22 shown in FIG. 3 is also constructed in the same manner as one shown in FIGS. 4 and 5. The slides 42 associated with the guiding rails 40 are used in the embodiment shown in FIGS. 4 and 5. However, any other suitable guiding device, such as linear bearings and the like, may be used instead of the combination of the guiding rails 40 and the slides 42.

In the embodiments shown in FIGS. 4 and 5, two guiding rails 40 are mounted on the main body 14 by any prior connecting means such as screws, and the supporting plate 44 is supported on two slides 42 sliding along two respective guiding rails 40. The door member 46 is mounted on this supporting plate 44 by any prior connecting means.

The second door element 22 is urged toward the first door element 20 by gravity, i.e., by weight of the second door element 22, in the embodiment shown in FIGS. 4 and 5. Therefore, the second door element 22 is usually positioned at a movable limit position on the side of the first door element 20 in the movable range where the guiding device 38 allows the second door element 22 to be guided, and covers only a part A of the opening 18 as shown in detail in FIG. 5. Similarly, when the second door element 22 is urged toward the first door element 20 by urging means such as springs 37 as shown in FIG. 3, the second door element 22 covers only a part of the opening 18. Preferably, the height of the part A is substantially equal to the thickness of fingers of a person, i.e., 15–20 mm. On the other hand, the rest of the opening 18 has a height enough to transfer the wafers at the top and the bottom of the wafer cassette 24 therethrough when the second door element 22 is positioned at the movable limit position on the side of the first door element 20 with the rest of the opening 18 left open by the first door element 20.

Preferably, the safety door 12 is further provided with a detector for detecting displacement of the second door element 22. It is possible to detect a part of a person's body caught between the first and second door elements 20, 22 by detecting displacement of the second door element 22, because the second door element 22 is urged toward the first door element 20 and is usually positioned at the movable limit position on the side of the first door element 20 in the movable range where the guiding device 38 allows the second door element 22 to be guided. If the detector 48 detects the part of the body caught in the safety door 12 (between the first and second door elements 20, 22), the operation of the safety door 12 can be controlled so as to open the driven first door element 20 and thereby to eliminate the state where the part of the body is caught there. Although a micro photo switch is used as the detector 48, any other suitable detectors may be used such as a contact switch including a micro switch and the like, a photo sensor, a magnetic sensor, a differential transducer for detecting displacement, and the like.

Figure 6:
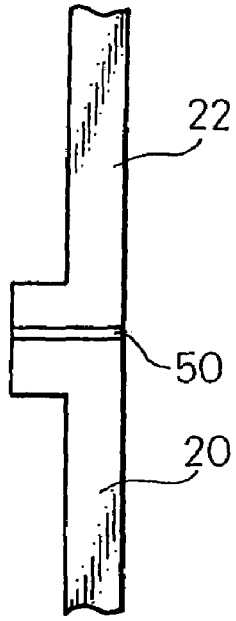
FIG. 6 is a side view of a portion of adjacent ends of the first and second door elements, showing a first embodiment of a structure for closing the opening by the first and second door elements.
Figure 7:
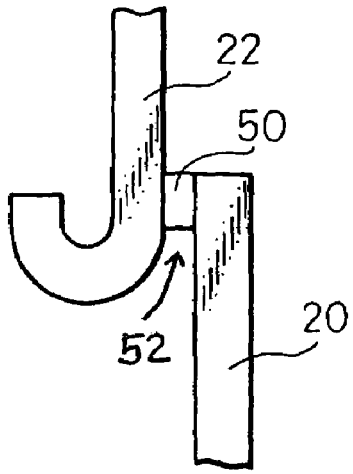
FIG. 7 is a side view of a portion of adjacent ends of the first and second door elements, showing a second embodiment of a structure for closing the opening by the first and second door elements.
Figure 8:
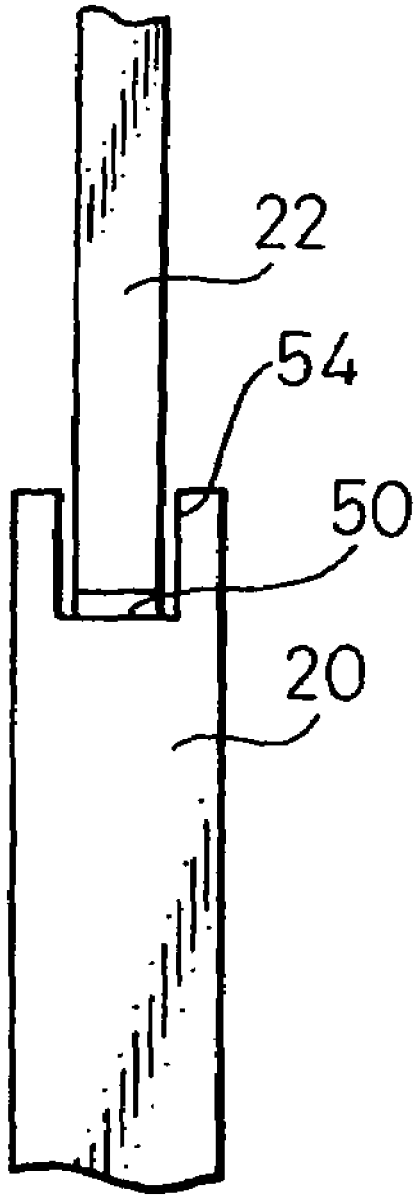
FIG. 8 is a side view of a portion of adjacent ends of the first and second door elements, showing a third embodiment of a structure for closing the opening by the first and second door elements.

FIGS. 6–8 are respective side views of a portion of adjacent ends of the first door element 20 and the second door element 22, showing different types of structures for closing the opening 18 by the first door element 20 and the second door element 22, respectively.

FIG. 6 shows a first embodiment of a structure for closing the opening 18 by the first door element 20 and the second door element 22 in the safety door 12. The opposed ends of the first and second door elements 20, 22 are formed in a L-shape and come into contact with each other to close the opening 18 of the main body 14. Only one of the two ends may be formed in a L-shape as shown in FIGS. 1 and 2, or one or both of the two ends may be rounded and formed in a J-shape. Preferably, the contacting surfaces of the ends of the first and second door elements 20, 22 are provided with sealing members 50.

FIG. 7 shows a second embodiment of a structure for closing the opening 18 by the first door element 20 and the second door element 22 in the safety door 12. The first door element 20 overlaps the second door element 22 so that they cooperate to close the whole of the opening 18 as shown in FIG. 7. There is a small gap 52 between the first and second door elements 20, 22 in the overlapping portion, which gap 52 prevents their surfaces from coming into contact with each other and causing friction. Preferably, the end of the second door element 22 is formed in a J-shape as shown in FIG. 7. The J-shaped end of the second door element 22 can reduce the pain felt by a person in case that, for example, fingers should be caught between two door elements 20, 22. In order to improve sealing quality between the first and second door elements 20, 22, a sealing member 50 may be attached to the contacting surface of the first door element 20 or the second door element 22 so as to full the gap 52 between the two door elements 20, 22 with it.

FIG. 8 shows a third embodiment of a structure for closing the opening 18 by the first door element 20 and the second door element 22 in the safety door. The first door element 20 comes into contact with the second door element 22 on the respective contacting surfaces. The first door element 20 is provided with a groove 54 which extends along the whole length of the contacting surface and into which the end of the second door element 22 is inserted. Thus, the first and second door elements 20, 22 cooperate with each other to close the whole of the opening 18. The size of the groove 54 of the first door element 20 is larger than that of the end of the second door element 22 so that the end of the second door element 22 can be inserted into the groove 54. Preferably, the edge of the end of the first and second door elements 20, 22 are chamfered to be rounded. The first and second door elements 20, 22 may be provided with sealing members 50 on the respective contacting surfaces of their ends.

Then, the operation of the safety door according to the present invention will be described with reference to the embodiment shown in FIGS. 1 and 2, wherein the first door element 20 is arranged in the upper side of the main body 14 and the second door element 22 is arranged in the lower side of the main body 14.

When the opening is made to open, the first door element 20 is moved to a position shown in FIGS. 1 and 2 where the end on the side of the opening 18 in the first door element 20 is positioned outside the periphery of the opening 18. The second door element 22 is urged toward the first door element 20 by gravity or the urging means such as springs 37 and is usually positioned at the limit position on the side of the first door element 20 in the movable range of the second door element 22 guided by the guiding device 38 so that it covers only a part A of the opening 18 as shown in detail in FIG. 4. Preferably, the height of the part A is substantially equal to the thickness of the fingers of a person, i.e., 15–20 mm.

When the opening is made to close, the first door element 20 is moved upward by the driving device 26 and to the upper movable limit position in its movable range which is mechanically restricted by the driving device 26 or the guiding device 32. At this upper movable limit position, a distance between the upper end of the first door element 20 and the upper edge of the opening 18 is larger than thickness of the fingers, preferably more than 15 mm. When the first door element 20 is moved to the upper movable limit position, the upper end of the first door element 20 comes into contact with the lower end of the second door element 22. Preferably, when the first door element 20 comes into contact with the second door element 22, the first door element 20 slightly pushes up the second door element 22. This ensures that the whole of the opening is closed.

If a foreign body such as the fingers of a person is caught in the safety door according to the present invention, the foreign body such as the fingers is moved upwardly by the driven first door element 20 and is then pushed against the second door element 22. Since the second door element 22 is urged downwardly toward the first door element 20 substantially by only its own weight due to gravity, it is moved upwardly along with the foreign body moved by the first door element 20 when the foreign body is caught between these two door elements 20, 22. This makes it possible to avoid risks of crushing a foreign body, such as fingers, between the first door element 20 and the second door element 22. At this time, a force applied to the foreign body, such as fingers, is substantially due to only weight of the second door element, and the upper end of the first door element 20 is spaced apart from the upper edge of the opening 18 by a distance greater than the thickness of the foreign body even when the first door element 20 is positioned at the upper movable limit position in its movable range. Therefore, the foreign body, in particular the fingers of the person, cannot be crushed.

When the second door element 22 is urged toward the first door element 20 by gravity as shown in FIG. 2, the force applied to the foreign body caught between the two door elements 20, 22 may be adjusted by adjusting the weight of the second door element 22. Similarly, when the second door element 22 is urged toward the first door element 20 by urging means such as springs 37 shown in FIG. 3, the force applied to the foreign body caught between the two door elements 20, 22 may be adjusted by adjusting an urging force of the urging means.

As described above, according to an apparatus, for manufacturing or inspecting semiconductors, having the safety door defined in claim 1, in case a part of a person such as a finger should be caught in the safety door due to incorrect actions of the safety door or human error, the second door element which is not driven can be moved so that the force applied to the part of the body caught in the safety door can be minimized. This makes it possible to avoid risks of injury to the part of the body caught in the safety door. Further, since the above-mentioned function is achieved by a mechanical structure, the safety door provides no possibility of incorrect action due to electrical causes such as faults in sensors or the like and therefore may provide more safety.

While the invention has been described with reference to specific embodiments chosen for purposes of illustration, it should be apparent that numerous modifications could be made thereto by those skilled in the art without departing from the basis concept and scope of the invention. Accordingly, a safety door according to the present invention may be applied to equipment other than an apparatus for manufacturing or inspecting semiconductors.

What is claimed is:

1. An apparatus, for manufacturing or inspecting semiconductors, having a safety door, the apparatus comprising:

a main body for manufacturing or inspecting the semiconductors;

an opening arranged in said main body; and said safety door comprising:

a first door for covering a first part of the opening, said first door having a movement direction along which said first door is driven by a driving device; and a second door for covering a second part of said opening, said second door not being operatively connected to said first door and being urged toward said first door by an external force, the external force being substantially the force of gravity, and wherein substantially only said external force resists movement of the second door parallel with the movement direction of the first door due to a force applied on the second door by a part of a person's body is trapped between the first and second doors, said second door comprising a guide for guiding said second door along the movement direction of said first door, and said second door being urged toward said first door by said external force, wherein said first door cooperates with said second door to close the whole of said opening when said first and second doors are in a closed position.

2. The apparatus according to claim 1, wherein said first door is arranged on a lower side of said main body, and wherein said second door is arranged on an upper side of said main body.

3. The apparatus according to claim 1, wherein said first door abuts against said second door when said first and second doors are in said closed position so that said first and second doors cooperate with each other to close the whole of said opening.

4. The apparatus according to claim 1, wherein said first door overlaps said second door so that said first and second when said first and second doors are in said closed position doors cooperate with each other to close the whole of said opening.

5. The apparatus according to claim 1, further comprising a detector for detecting displacement of said second door.

6. The apparatus according to claim 1, wherein the driving device comprises an air cylinder.

7. The apparatus according to claim 1, wherein the driving device comprises a linear accelerator.

8. A safety door for closing an opening arranged in a wall, said safety door comprising:

a first door for covering a first part of said opening, said first door having a movement direction along which said first door is driven by a driving device; and a second door for covering a second part of said opening, said second door not being operatively connected to said first door and being urged toward said first door by an external force, the external force being substantially the force of gravity, and wherein substantially only said external force resists movement of the second door parallel with the movement direction of the first door due to a force applied on the second door by a part of a person's body when trapped between the first and second doors, said second door comprising a guide for guiding said second door along the movement direction of said first door, and said second door being urged toward said first door by said external force, wherein said first door is adapted to cooperate with said second door to close the whole of said opening when said first and second doors are in a closed position.

9. The safety door according to claim 8, wherein said first door is adapted to be arranged on a lower side of said wall, and wherein said second door is adapted to be arranged on an upper side of said wall.

10. The safety door according to claim 8, wherein said first door abuts against said second door when said first and second doors are in the closed position so that said first and second doors are adapted to cooperate with each other to close the whole of said opening.

11. The safety door according to claim 8, wherein said first door overlaps said second door when said first and second doors are in the closed position so that said first and second doors are adapted to cooperate with each other to close the whole of said opening.

12. The safety door according to claim 8, further comprising a detector for detecting displacement of said second door.

13. The safety door according to claim 8, wherein the driving device comprises a linear accelerator.

14. The safety door according to claim 8, wherein the driving device comprises an air cylinder.

15. An apparatus, for manufacturing or inspecting semiconductors, having a safety door, the apparatus comprising:

a main body for manufacturing or inspecting the semiconductors;

an opening arranged in said main body, and said safety door comprising:

a first door and a second door, said first door having a movement direction along which said first door is driven by a driving device, said first door having a limit position in the movement direction of the first door, where said first door covers a part of the opening so as to leave a predetermined gap between said first door and said main body, wherein said second door is not operatively connected to said first door and said second door is urged toward said first door by an external force which is substantially the force of gravity, and wherein substantially only said external force resists movement of the second door parallel with the movement direction of the first door due to a force applied on the second door by a part of a person's body when trapped between the first and second doors, said second door comprising a guide for guiding said second door along the movement direction of said first door, said second door being urged by said external force to a guide limit position where said second door covers the predetermined gap, wherein said first door cooperates with said second door to close the whole of said opening when said first door is moved to the limit position of the first door and said second door is in abutting relation with said first door.

16. An apparatus, for manufacturing or inspecting semiconductors, having a safety door, the apparatus comprising:

a main body for manufacturing or inspecting the semiconductors, said main body having an opening arranged therein;

said safety door comprising a first door and a second door, said first door having a movement direction along which said first door is driven by a driving device; and a guide for guiding said second door along the movement direction of said first door, wherein said first door has an upper limit position where said first door covers a part of the opening so as to leave a predetermined gap between said first door and said main body, and wherein said second door is not operatively connected to said first door and said second door is urged toward said first door by an external force which is substantially force of gravity, and wherein substantially only external force resists movement of the second door along the movement direction of the first door due to a force applied on the second door by a part of a person's body when trapped between the first and second doors, and said second door is urged by said external force to a guide limit position where said second door covers the predetermined gap, and wherein said first door cooperates with said second door to close the whole of said opening when said first door and said second door is in abutting relation with said first door is moved to the upper limit position of the first door.

* * * * *